US005876110A

United States Patent [19]

Uke

[11] Patent Number: 5,876,110

[45] Date of Patent: Mar. 2, 1999

[54] MULTIPLE SELECTABLE BULB FLASHLIGHT

[76] Inventor: Alan K. Uke, 1020 Linda Vista Dr., San Marcos, Calif. 92069

[21] Appl. No.: 901,494

[22] Filed: Jul. 28, 1997

[51] Int. Cl.[6] ..... F21L 7/00

[52] U.S. Cl. ..... 362/184; 362/197; 362/205; 362/287

[58] Field of Search ..... 362/197, 202, 362/184, 205, 287, 285, 418

[56] References Cited

U.S. PATENT DOCUMENTS

| | | | |
|---|---|---|---|
| 1,613,203 | 1/1927 | Shannon . | |
| 2,245,707 | 6/1941 | Packer | 362/184 |
| 2,264,198 | 11/1941 | Chak . | |
| 2,312,844 | 3/1943 | Moxley . | |
| 2,330,673 | 9/1943 | Braum . | |
| 4,414,612 | 11/1983 | Conforti et al. | 362/188 |
| 4,803,605 | 2/1989 | Schaller et al. | 362/184 |
| 5,558,430 | 9/1996 | Booty, Jr. | 362/184 |

*Primary Examiner*—Thomas M. Sember
*Attorney, Agent, or Firm*—Michael H. Jester

[57] ABSTRACT

A flashlight has a water tight cylindrical battery casing and a sealed cylindrical closure which screws over the forward open end thereof. The closure includes a lens and a parabolic reflector. A first PC board fixed in the closure serves as a support member for a second PC board that serves as a mounting member for a pair of bulbs. The second PC board is pivotally connected to the first PC board in front thereof in overlapping fashion. The pins of the bulbs are plugged into forward opening pin receptacles in the second PC board. The second PC board can swing back and forth to move the bulbs through an arcuate slot in the reflector into and out of the focal point of the reflector. A manual actuator located on the outside of the casing can be toggled by a diver's hand and its motion is carried by a sealed linkage through the casing to pivot the second PC board. This allows the diver to selectively position a spare one of the two bulbs in the focal point of the reflector in case the bulb in use fails or to select a bulb with a higher intensity. This same motion also completes an electrical circuit through the two PC boards between the selected bulb and the battery so that the selected bulb is energized. A lamp head of the aforementioned configuration without batteries may be connected through a conductor cable to a separate battery pack having an ON/OFF switch.

52 Claims, 10 Drawing Sheets

MULTIPLE SELECTABLE BULB FLASHLIGHT

BACKGROUND OF THE INVENTION

The present invention relates to flashlights and pertains particularly to an improved flashlight having multiple selectable bulbs.

Handheld flashlights are widely used as a primary source of light in many remote locations, especially where access to electrical distribution networks is not available. They have their own power source typically in the form of one or more batteries. Simpler, less expensive flashlights typically employ a number of small cylindrical alkaline batteries disposed end to end in a small diameter cylindrical housing. Most high powered, more expensive lights typically employ groups of dry cell batteries in arrays making up six or twelve volts in larger housings. Others employ larger single cubic shaped dry cell batteries which are typically six or nine volts. These lights usually have a handle attached to and extending outward from the housing shaped to provide a comfortable hand grip.

The electrical circuit of a conventional flashlight comprises a battery and a single light bulb positioned in a reflector with electrical conductors connecting the battery to the bulb and a switch for selectively interrupting and completing the circuit to energize the bulb and activate the light.

Reliable flashlights are essential tools for divers who routinely encounter reduced visibility under water. A flashlight must be reliable so that the diver is not likely to be left without a light should a component of the light, such as the bulb, fail. It should also be reasonably easy to carry and manipulate in view of the heavy protective clothing and gloves often worn by a diver.

Divers also frequently encounter different conditions while diving which require different light intensities in order to effectively illuminate an area of interest. It is well known that certain light sources (e.g. halogen) better penetrate certain types of water conditioner atmosphere than others.

Accordingly, there is a need for a flashlight having multiple selectable bulbs in order to provide a backup source in case of failure of one bulb and/or multiple bulbs of different illumination amounts.

SUMMARY OF THE INVENTION

It is the primary object of the present invention to provide a new and improved diver's flashlight having multiple selectable bulbs that is simple in construction and reliable in operation.

In accordance with a primary aspect of the present invention, a flashlight, comprises a water tight a housing, moveable mounting means inside said housing for mounting multiple light bulbs, circuit means in said housing for alternately connecting a selected one of said light bulbs to a source of power for energizing the bulb, said mounting means being moveable to selectable positions for energizing selected ones of said multiple bulbs, a manually moveable actuator mounted outside said housing, a linkage connected between said actuator and said mounting means for simultaneously moving and energizing selected ones of said bulbs upon movement of said actuator, and a water tight seal surrounding a portion of the linkage that extends through the housing.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
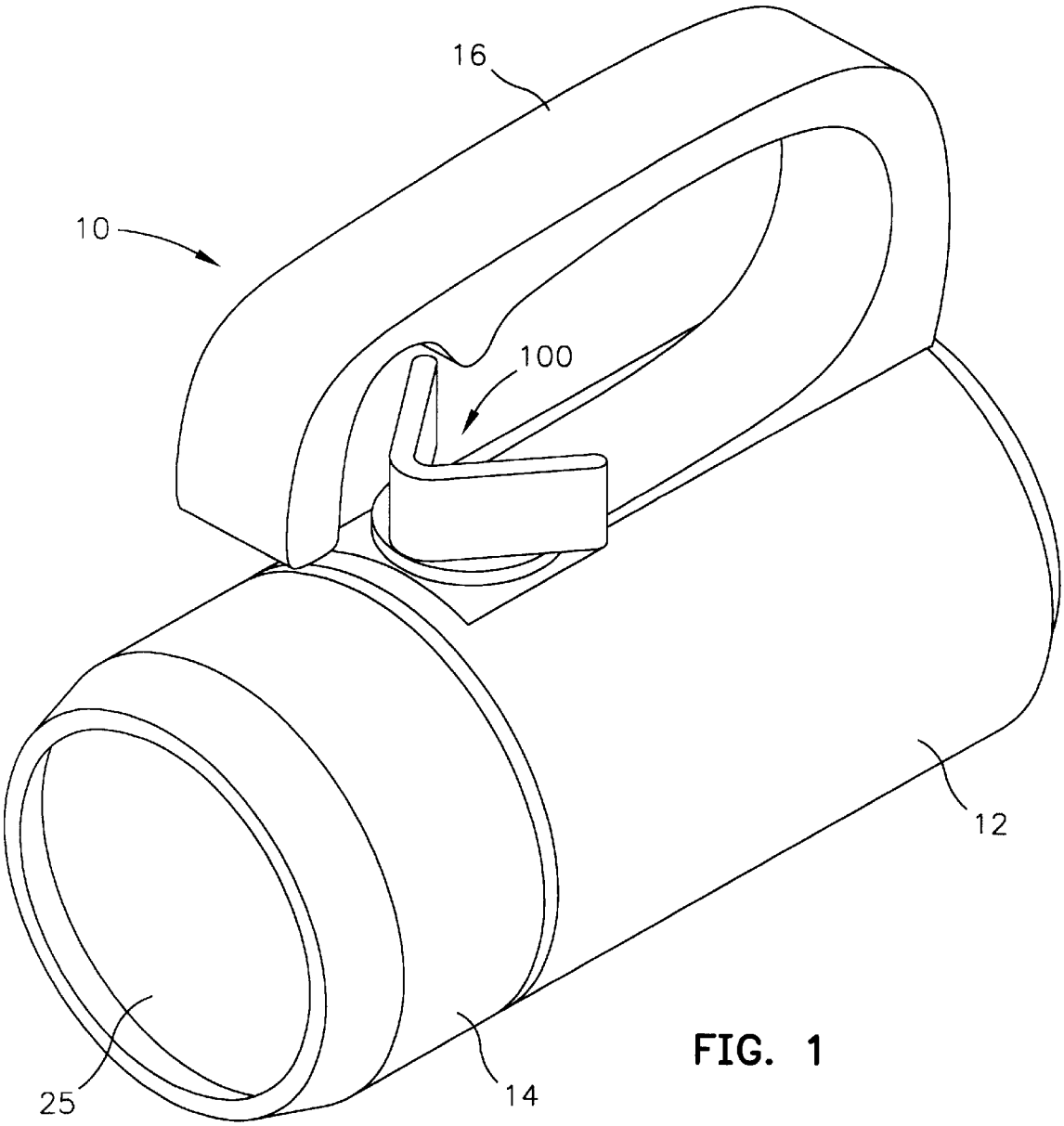
FIG. 1 is a perspective view of a flashlight in accordance with a preferred embodiment of the invention.

Referring to FIG. 1 of the drawings, a flashlight of the type sometimes called a lamp or lantern is illustrated and designated generally by the numeral 10. The flashlight comprises a main body or casing 12 and a threadably detachable head assembly or closure 14 which also includes a lens 25. Together the casing 12 and the closure 14 provide a water tight housing as hereinafter described in detail. The casing 12 is of a generally cylindrical configuration having a closed end and an open end and forming a tubular chamber or cavity for receiving and mounting of a battery. The illustrated embodiment is formed for the receipt of any suitable battery or battery pack such as a six volt battery of the lantern type, or a pack of multiple dry cell batteries, such as four or eight pack. The casing 12 is formed with a handle 16 extending above and forward of the casing 12 with a large opening or spacing to enable grasping by a gloved hand. The casing 12 is made water tight and may be made of any suitable durable high impact non-corrosive material, such as a plastic, and may be formed by injection molding.

Figure 2A:
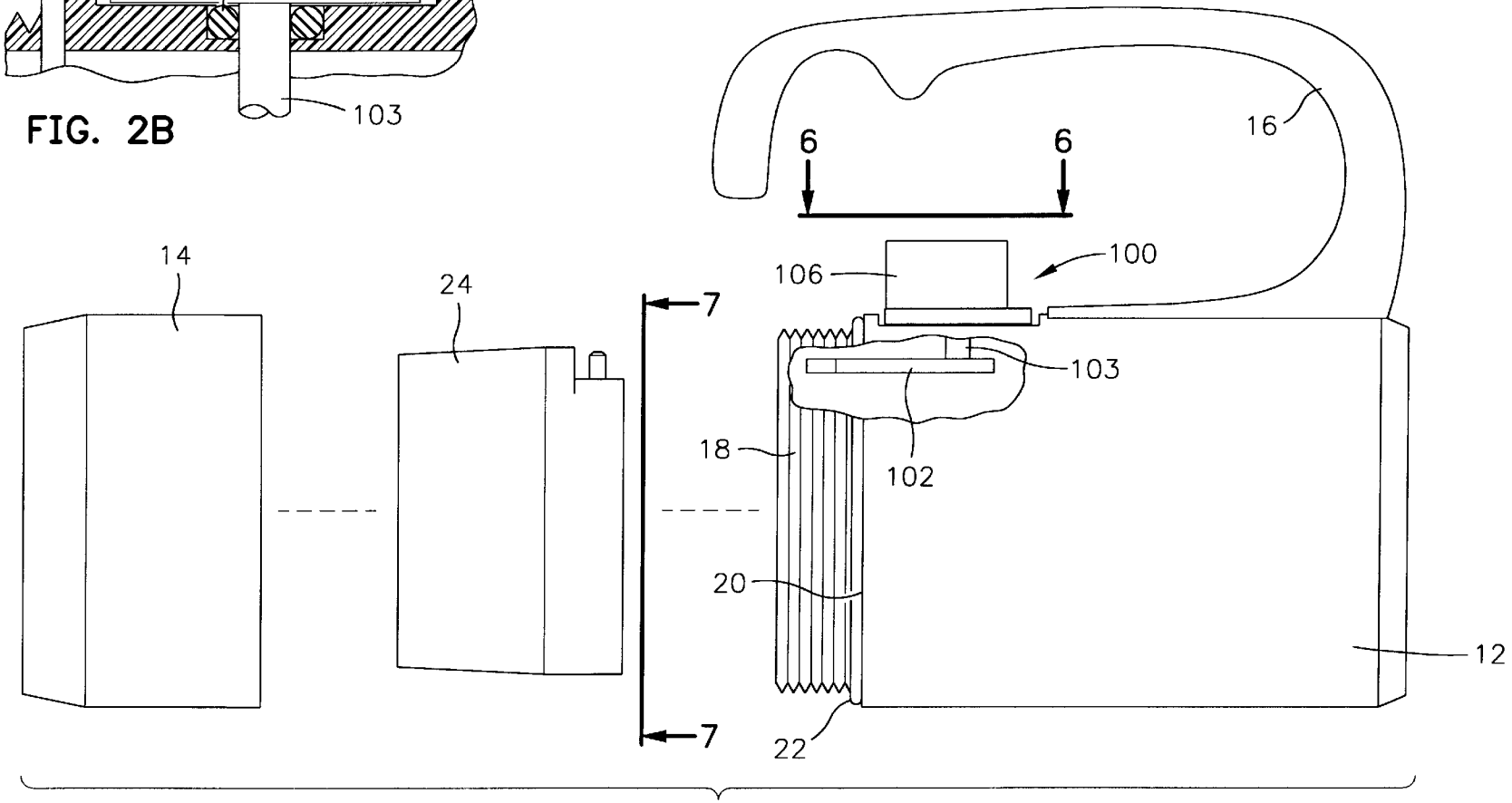
FIG. 2A is an exploded view of the flashlight of FIG. 1 with a portion broken away showing the major components thereof.

As best seen in FIG. 2A, the open end of the casing 12 is formed with a reduced diameter portion having external threads 18 and forming a shoulder 20 against which is mounted an O-ring 22 for sealing the casing 12 in a water tight manner. The closure 12 assembly 14 threadably mounts on the external threads 18 and captures and encloses a support 24 including light bulbs 30 and 32 (FIGS. 3–5), a reflector 26 and electrical circuitry hereafter described.

Figure 3:
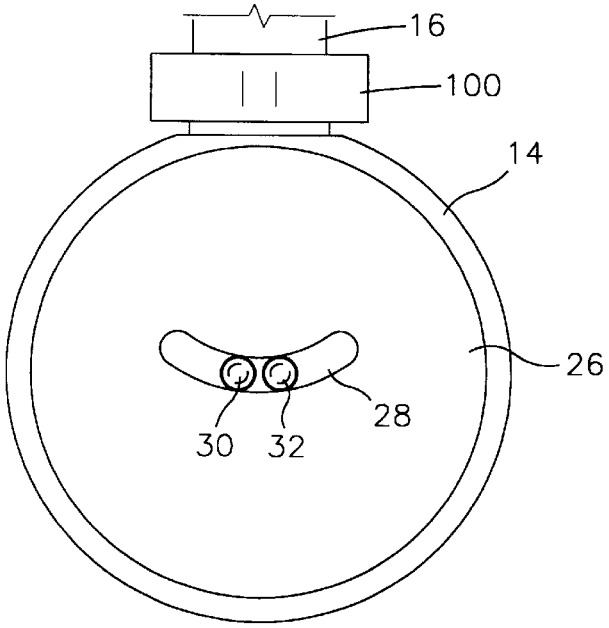
FIG. 3 is a front elevation view of the flashlight of FIG. 1 showing the light in the unenergized condition.
Figure 4:
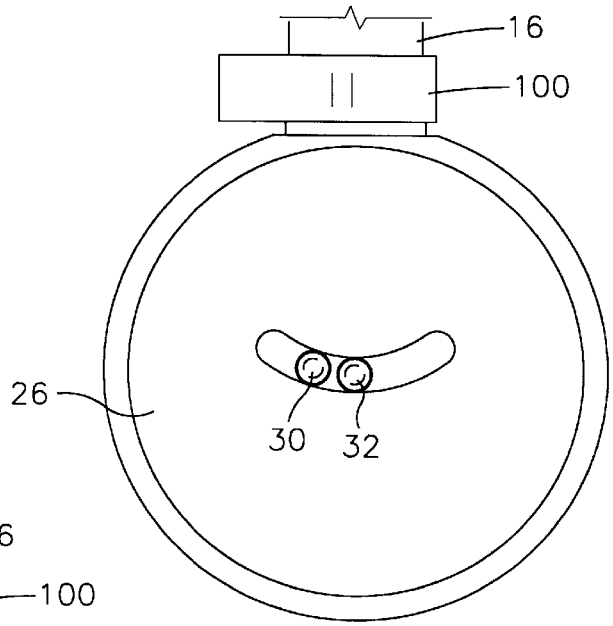
FIG. 4 is a front elevation view of the flashlight of FIG. 1 showing the flashlight with one bulb in the energized condition.
Figure 5:
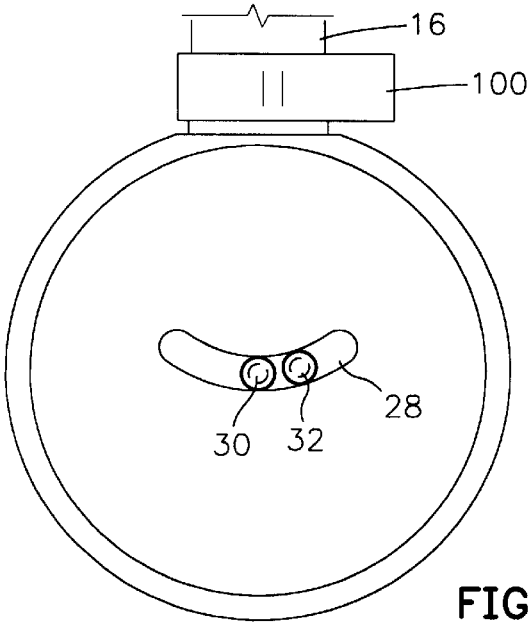
FIG. 5 is a front elevation view of the flashlight of FIG. 1 showing the flashlight with the other bulb in the energized condition.

Referring to FIG. 3, the forward end of the support assembly 24 includes a reflector 26. The reflector 26 positioned behind the lens 25 is configured to have a focus and may be parabolical, ellipsoidal, spherical or any other suitable configuration. The center of the reflector 26 is formed with an arcuate slot 28 through which the light bulbs 30 and 32 project. The bulbs 30 and 32 may be selectively moved from a centered in-activated position (FIG. 3) to one of two laterally activated positions, as shown in FIGS. 4 and 5. The bulbs 30 and 32 may both be identical bulbs such that one is merely a backup bulb, or they may be different types of bulbs with different intensities suitable for different visibility or lighting conditions. The bulbs 30 and 32 are mounted on a combined switch and bulb positioner, as will be subsequently discussed, that simultaneously moves the selected bulb into the focal point of the reflector 26 and completes the circuit.

The bulbs are shown in FIG. 3 in the non-energized position wherein one bulb is on one side of the focal point and the other bulb is on the other side.

Referring to FIG. 4, the bulb 32 is shown in the centered position substantially at the focal point of the reflector and energized. The bulb 30 is shown moved further out from the focal point.

Referring to FIG. 5 the bulb 30 is shown moved to the centered position substantially in the focal point of the reflector and energized. The bulb 32 is shown moved further away from the focal point.

Figure 6:
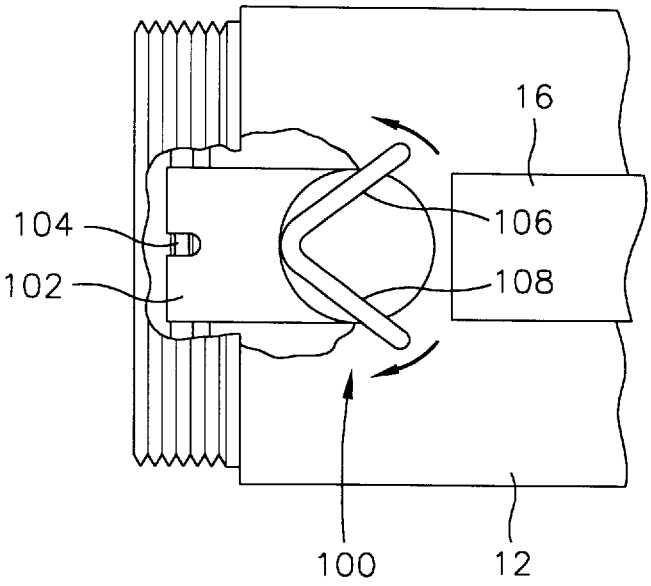
FIG. 6 is an enlarged top plan view of the actuator.

Referring to FIG. 1, a manually moveable actuator for the flashlight is illustrated and designated generally at 100. The actuator 100 (FIG. 6) comprises a V-shaped lever with arms 106 and 108 on the outside of the housing connected to a element 102 on the inside of the housing. The lever 102 is connected to a moveable member in which the bulbs are mounted, as will be explained. The actuator 100 is connected to the lever 102 by shaft 103 (FIG. 2B) that extends through a water-tight seal 101 in the casing 12. The lever 102 and shaft 103 provide a linkage to a mounting member hereafter described in detail.

Figure 7:
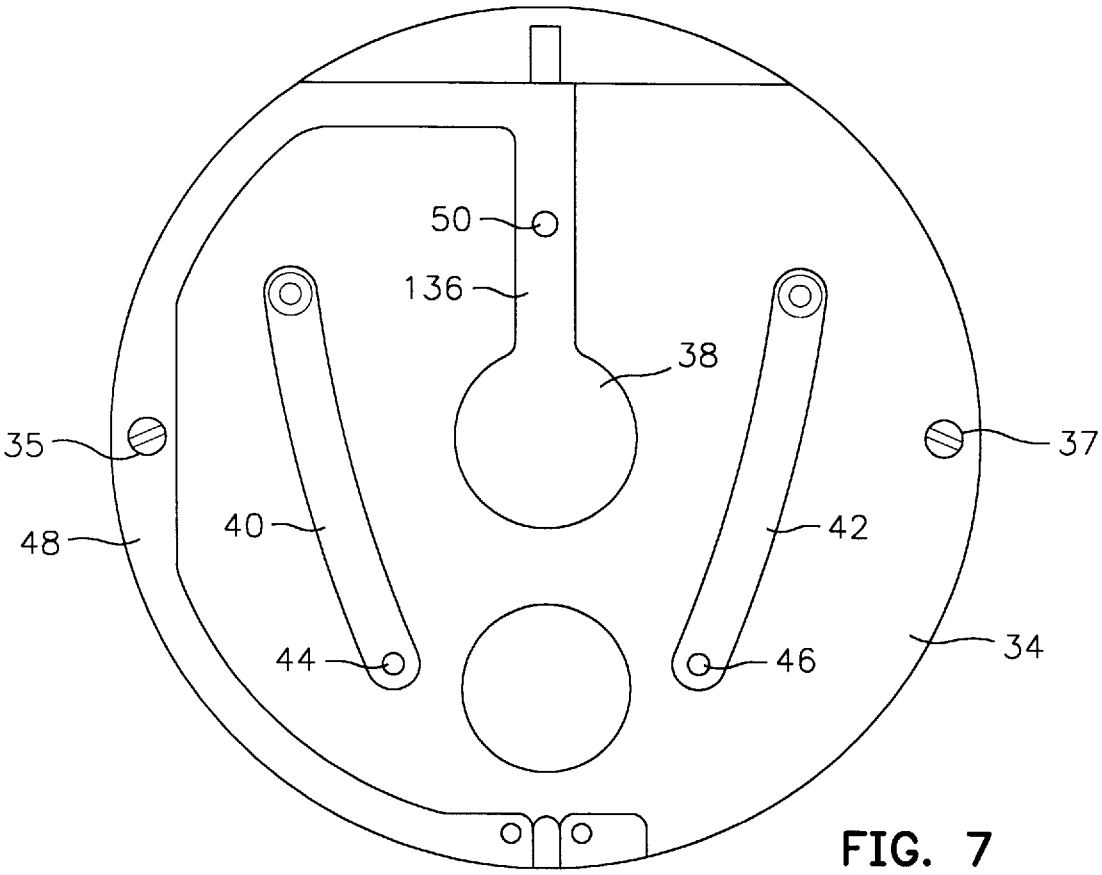
FIG. 7 is an enlarged rear elevation view of the PC board inside the flashlight taken on line 7—7 of FIG. 2.

The electrical circuitry for energizing the bulbs 30 and 32 is mounted on a printed circuit ("PC") board in the head assembly, as illustrated in FIG. 7. The PC board comprises a generally circular non-conductive support or substrate member 34 having a printed circuit on the rear side or back face thereof. The circuit includes a conductive strip or member 36 having a centrally positioned negative terminal 38 for engagement with the negative terminal of a battery (not illustrated) within the casing 12. A pair of laterally disposed or positioned conductive strips or members 40 and 42 include positive terminals at 44 and 46 for engagement with the positive terminal of the battery. A half circle conductive strip 48 extends around the peripheral edge of the PC board 34 and connects with a through conductor at 50 to provide a switch, as will be subsequently explained. The PC board 34 is detachably mounted to the back of support assembly 24, such as by screws 35 and 37. It will be appreciated that the battery or batteries for powering the flashlight 10 may be in a separate housing and connected by a conductor cable to that portion having the bulbs and switch as later described in connection with FIG. 17. The switch can be separate from the moveable member hereafter described and the lever 102 may also be connected to the separate switch to actuate it.

Figure 8:
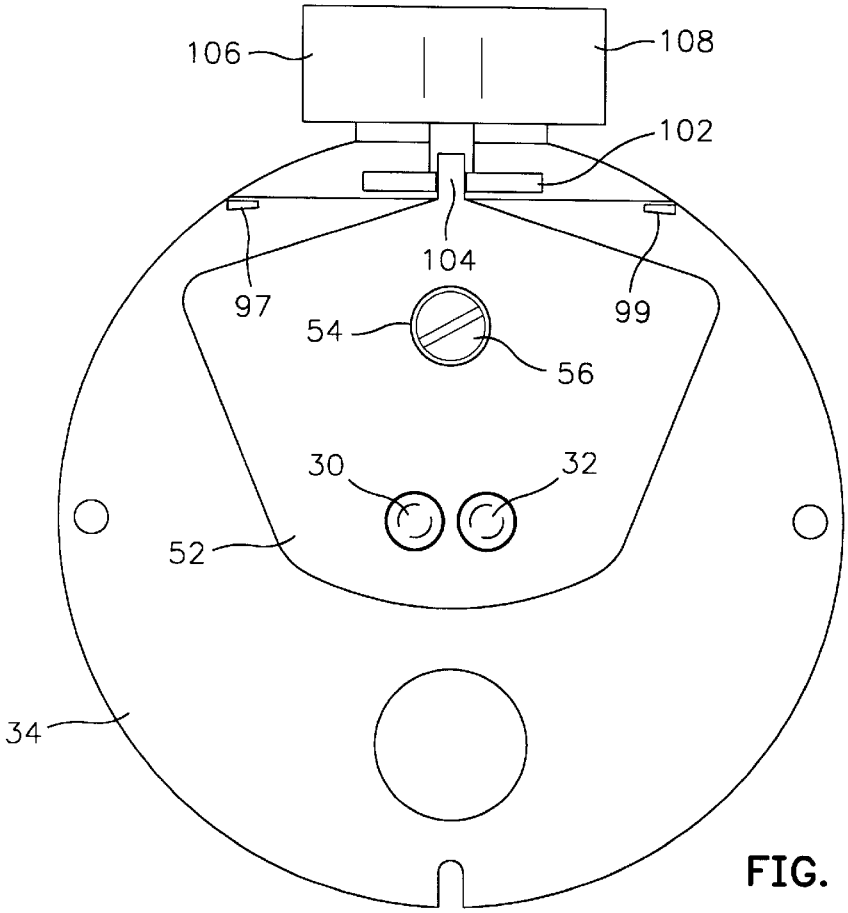
FIG. 8 is a front elevation view of the PC board showing the combined switch and bulb positioner mounted thereon.
Figure 9:
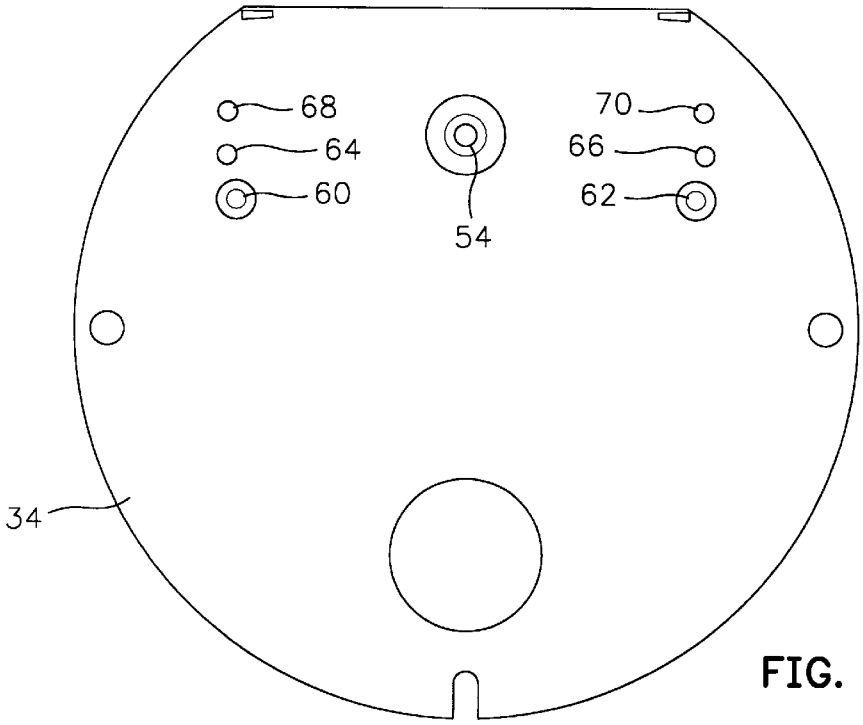
FIG. 9 is view like FIG. 8 with the switch and bulb positioner removed.
Figure 11:
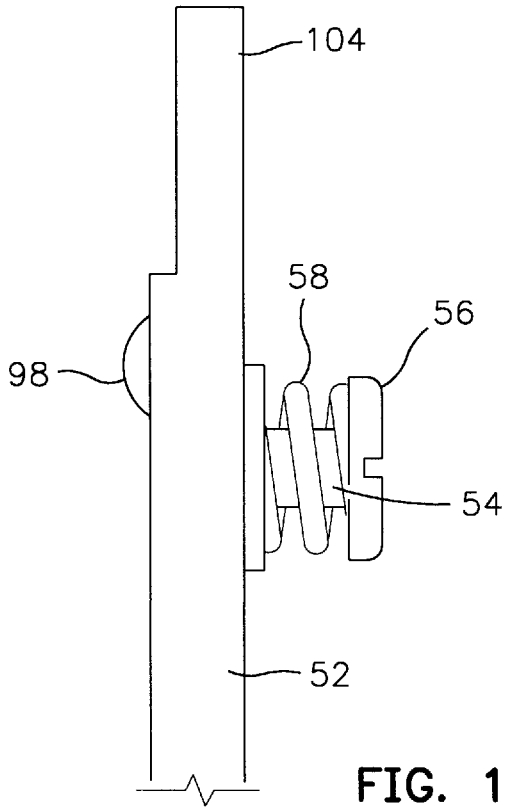
FIG. 11 is a side elevation view of the switch and bulb positioner of FIG. 10.

Referring now to FIGS. 8 and 9, a front face of the PC board 34 is illustrated with a mounting or toggle member 52 pivotly mounted on a conductive pivot shaft 54 conducting through the substrate to the conductor 50, as seen in FIG. 7. The toggle member 52 mounts or carries light bulbs 30 and 32 and selectively positions them one at a time in the center of and substantially at the focal point of the reflector 26. The toggle member 52 functions as a switch for activating or completing the circuit to selectively energize the respective bulbs 30 and 32. The toggle member 52 is mounted on the shaft 54 by means of a spring assembly, as shown in FIG. 11, enabling the toggle member 52 to ride up and down and function with detents, as will be explained. A large head screw 56 is threadably mounted in the center of the shaft 54 and captures a coil spring 58 (FIG. 11) which biases against the screw 56 and the face of the toggle member 52 to bias it against the face of the PC board 34. The toggle member 52 may also be mounted in any other suitable manner such as by a clip retainer or other equivalent structure.

Referring to FIG. 9, the PC board 34 is formed on the front face with conductive contact 60 which connects through from the connector strip 42 (FIG. 7) on the back and contact conductive 62 (FIG. 9) which connects through from the conductor strip 40 (FIG. 7) on the back. These contacts 60 and 62 are formed as detents which are cooperatively engaged by hemispherical contact or terminal projections on the toggle member 52, as will be explained. Additional detents 64, 66, 68 and 70 are formed in the PC board 34 above the respective detent contacts 60 and 62 for engagement by detent projections on the toggle member 52.

Figure 10:
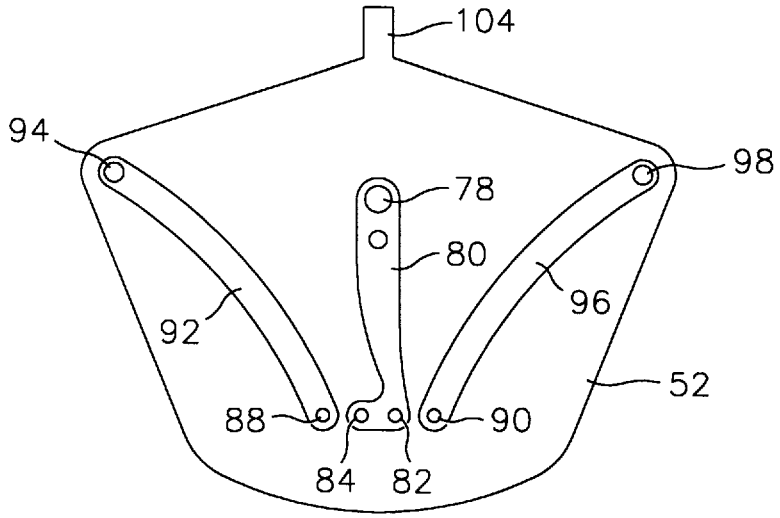
FIG. 10 is a view of the back of the switch and bulb positioner of FIG. 8.

Referring to FIG. 10, a back view of the toggle member 52 is illustrated showing the circuit for the switch. The toggle member 52 is preferably provided by a printed circuit board (PC) and carries a conductive sleeve or through connection 78 having a connection to an upper flared contact area portion of a conductive strip 80 on the face thereof. The sleeve 78 is connected by the conductor strip 80 to a pair of common pin receptacles 82 and 84 at the bottom of the toggle member 52 which receive pins from the light bulbs 30 and 32. An additional pair of pin receptacles 88 and 90 receive the other pins of the respective light bulb to complete the connection of the bulbs in the circuit. The pin receptacle 88 is connected by a conductor strip 92 to a hemispherical shaped conductive detent projection 94 on toggle 52 which cooperatively engages with conductive contact 62 or the respective non-conductive detents 66 and 70 (FIG. 9) when the toggle mechanism is rocked to the respective positions. The other pin receptacle 90 (FIG. 10) is conducted by a conductive strip 96 to a hemispherical shaped conductive detent projection 98 which cooperatively engages conductive contact 60 or the respective non-conductive detents 64 and 68 (FIG. 9). This detent action holds the toggle member 52 in a respective selected position of no light, or one or the other of the bulbs 30 and 32 energized.

Referring to FIG. 11, a side view of the toggle member 52 is illustrated showing the screw 56 and spring 58 mounting of the toggle member. The screw 56 compresses the spring 58 against the face of the toggle member 52 and forces it against the face of the PC board 34. This biases the conductive detent projections 94 and 98 into the respective detents. When the toggle member 52 is in the central position as shown in FIG. 8, detent projections 94 and 98 are seated in detents 64 and 66 (FIG. 9) and thereby the bulbs 30 and 32 are positioned to both sides of the center of the reflector 26. The circuit is broken with no light energized. When the toggle member 52 is tilted to one side or the other, the conductive detent projections 94 and 98 engage with one or the other of the contact detents 60 or 62 to thereby complete the circuit and energize the respective bulb simultaneously with positioning the bulb in the center of the reflector 26. Thus, one or other of the bulbs 30 and 32 is simultaneously selectively positioned substantially in the focal print of the reflector 26 and energized. Stop members 97 and 99 (FIG. 8) limit the movement of the toggle member 52 in either direction.

The toggle member 52 is pivoted between its activated and inactivated positions by means of the actuator 100 (FIGS. 1 and 6) mounted outside the casing 12 below the handle 16. The actuator 100 is connected through the shaft 103 (FIG. 2) to the lever 102 inside the casing 12 which engages flange or pin 104 (FIGS. 6 and 8) extending from top of the toggle member 52. The flange 104 rides in a notch formed in the forward edge of the lever 102. The actuator arms 106 and 108 are ergonomically designed and positioned for ease of operation. This actuating mechanism is designed to provide ease of operation by a diver having a gloved hand.

The combined switch and positioning mechanism may also take other forms, such as a slide member. Additionally, it may activate any number of light bulbs capable of being mounted within the light assembly.

Figure 12:
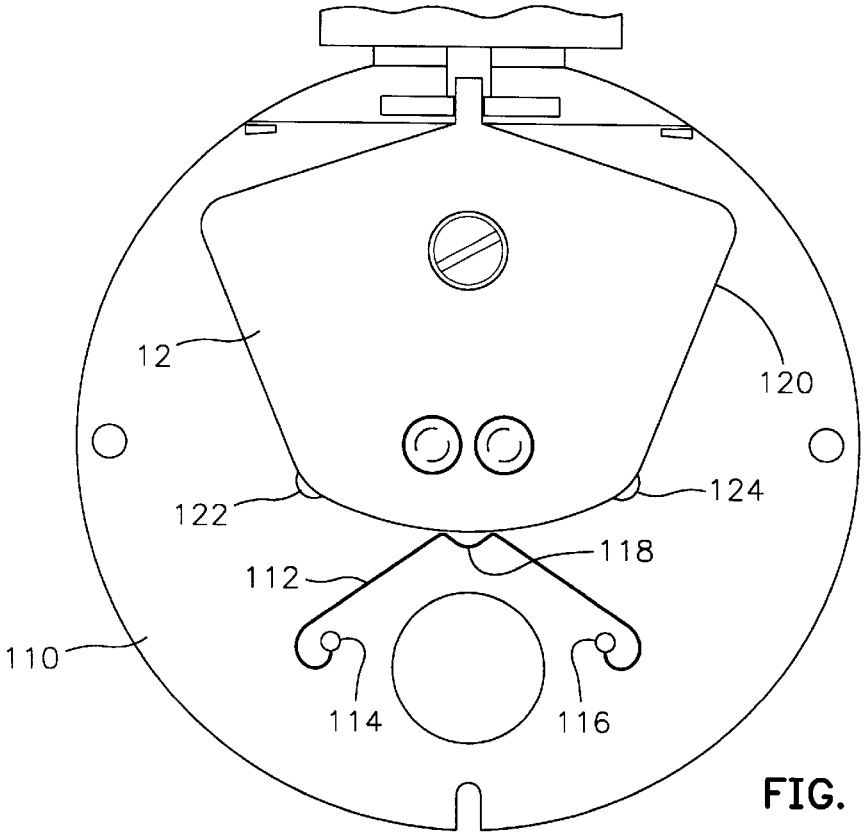
FIG. 12 is a view like FIG. 8 of the switch and bulb position of an alternate embodiment of the invention.

Referring to FIG. 12, an alternate construction of the switch is illustrated wherein a PC board 110 is substantially identical to the previously described PC board 34 except the detents are eliminated from the board. A V-shaped conductive spring 112 connects through the PC board 110 at through connectors 114 and 116 to the positive conductor strips on the back of the PC board 110 as in the prior embodiment. The back of the PC board 110 is otherwise identical to the back of the prior PC board 34. This spring 112 is formed with a bend or curve 118 to cooperate with contacts on a toggle member 120 and act as both a detent and switch contact.

The toggle member 120 is substantially like the toggle 52 member except that the detent projections and their electrical connections as seen in FIG. 10 are modified to provide switch contacts 122 and 124 in spaced relation along a lower peripheral edge. These contacts 122 and 124 are connected to conductors in the pin receptacles for the light bulbs as in the prior embodiment. Upon movement of the toggle member 120 to either side, a switch contact 122 or 124 engages the detent 118 of the spring 112 and makes electrical connection of the battery to the corresponding light bulb 30 or 32.

Figure 13:
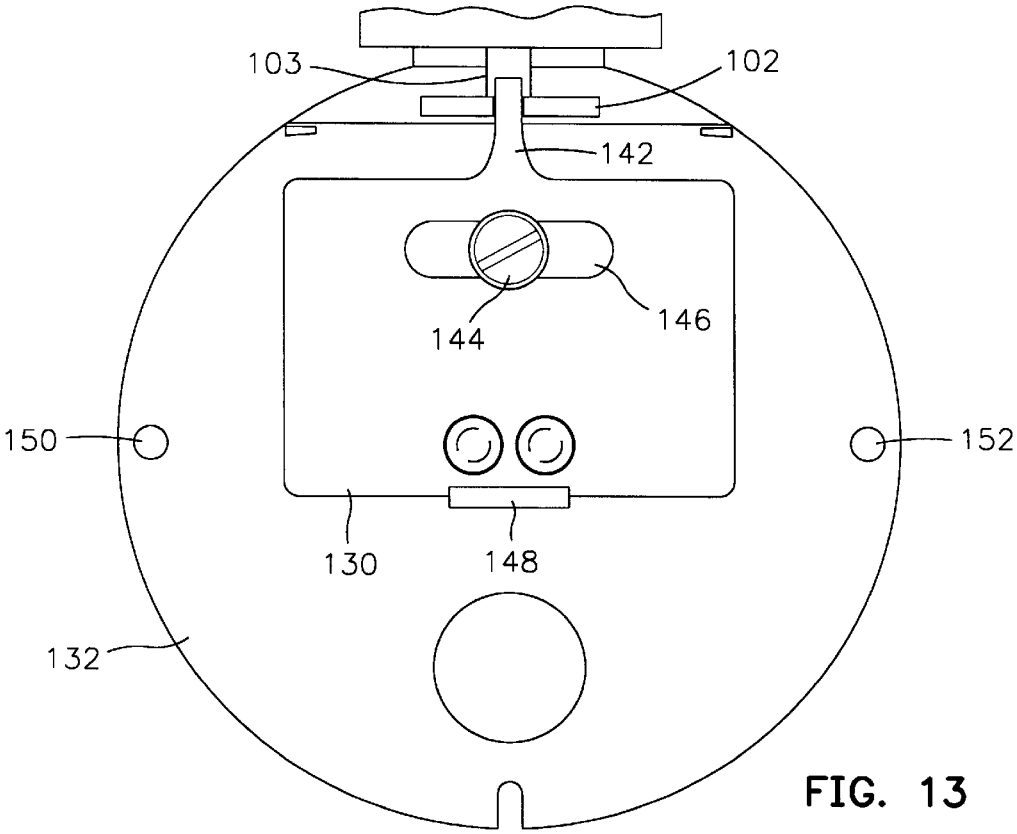
FIG. 13 is a view like FIG. 12 of the switch and bulb position of another embodiment of the invention.
Figure 14:
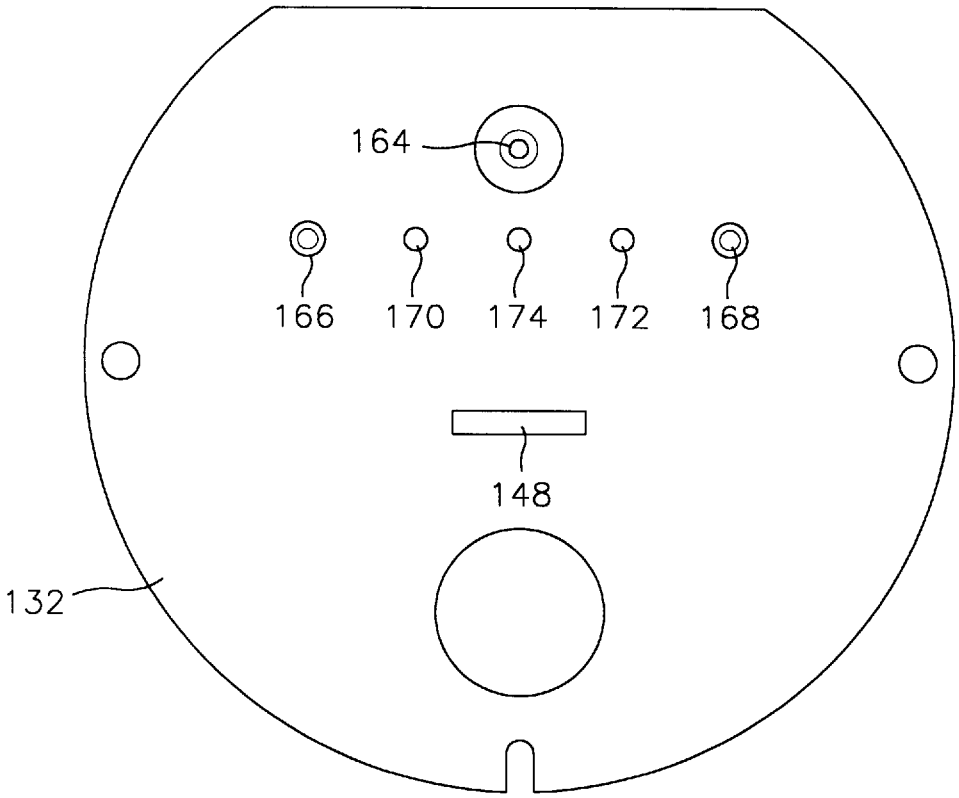
FIG. 14 is a view like FIG. 9 of the PC board of FIG. 13.
Figure 15:
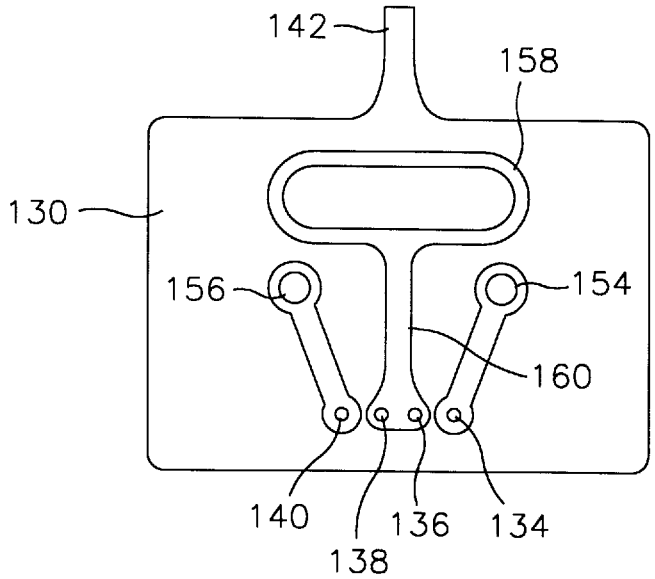
FIG. 15 is a view like FIG. 10 of the switch and bulb positioner of the embodiment of FIG. 12.

Referring to FIGS. 13–15, a further embodiment is illustrated wherein the switch and positioning mechanism takes another form, namely, a slide member 130 mounted on a slightly modified PC board 132. The PC board 132 is substantially identical to the prior board 34, except that the detents are in a single line across the face of the board, as seen in FIG. 14. The slide member 130 is also formed as a PC board and is provided with pin sockets 134, 136, 138, and 140 connected into a switch circuit on the slide such as illustrated in FIG. 15. The slide member 130 has a finger 142 for engagement by the lever 102 is retained on the face of the PC board by suitable screw 144 engaging in a slot 146, and a small guide bracket 148 having an overlying portion overlapping the slide member 130. A pair of stops 150 and 152 limit movement of the slide.

The slide member 130 is provided with a pair of detent projections 154 and 156 (FIG. 15) which serve as switch contacts and are connected by printed circuit strips to pin sockets 134 and 140. A slide contact 158 connects by conductor strip 160 to pin sockets 136 and 138 and engages a through conductor 164 (FIG. 14) on the PC board 132 which connects to the battery contacts, as in prior embodiments. The detent projections 154 and 156 alternately engage detent contacts 166 and 168 which are connected through to negative terminal strips on the back of the PC board 132 as in the prior embodiments. A pair of neutral detents 170 and 172 are engaged by the detent projections 154 and 156 to position the bulbs in the neutral position. A central neutral detent 174 may be engaged by an alternate one of the projections upon electrical contact by the other one.

Figure 16:
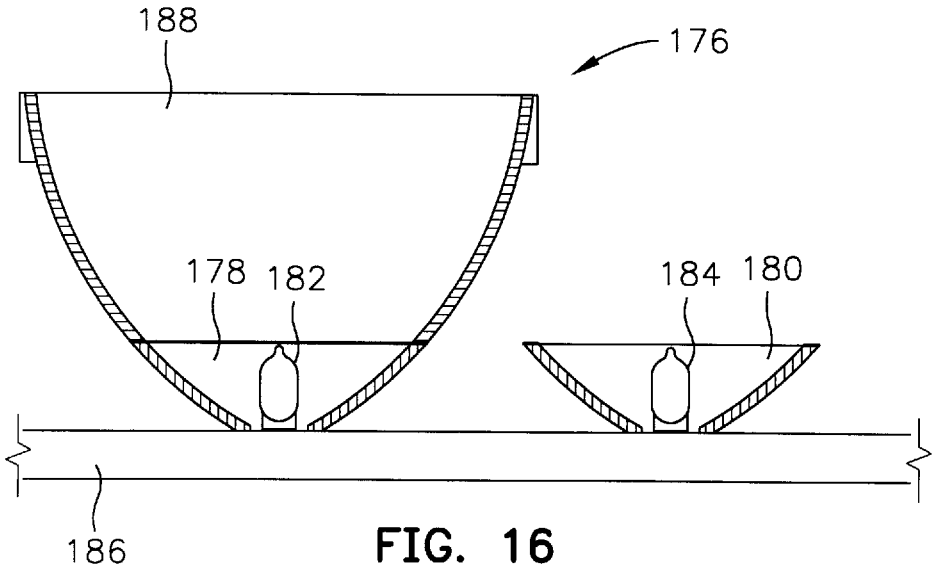
FIG. 16 is a side elevation view of an alternate reflector arrangement.

Referring to FIG. 16, a modification of the present invention is illustrated which avoids the interruption in the reflector 26 caused by the arcuate slot 28 (FIG. 3) that accommodates movement of the bulbs 30 and 32. In this modification, a two part reflector is illustrated and designated generally by the numeral 176. The reflector comprises a smaller base or inner portion 178 and 180 for each of a plurality of bulbs 182 and 184 mounted on a moveable mounting member 186 as in the prior embodiments. The inner portions 178 and 180 contain the focal point of the reflector wherein each bulb is preferably positioned so that the light is generated at the focal point. A larger continuation outer portion 188 of the reflector is mounted in the flashlight housing for the portion 178 or 180 containing a bulb to align with when the bulb is energized. The reflector 176 is preferably of the type such as parabolic, ellipsoidal or spherical.

Figure 17:
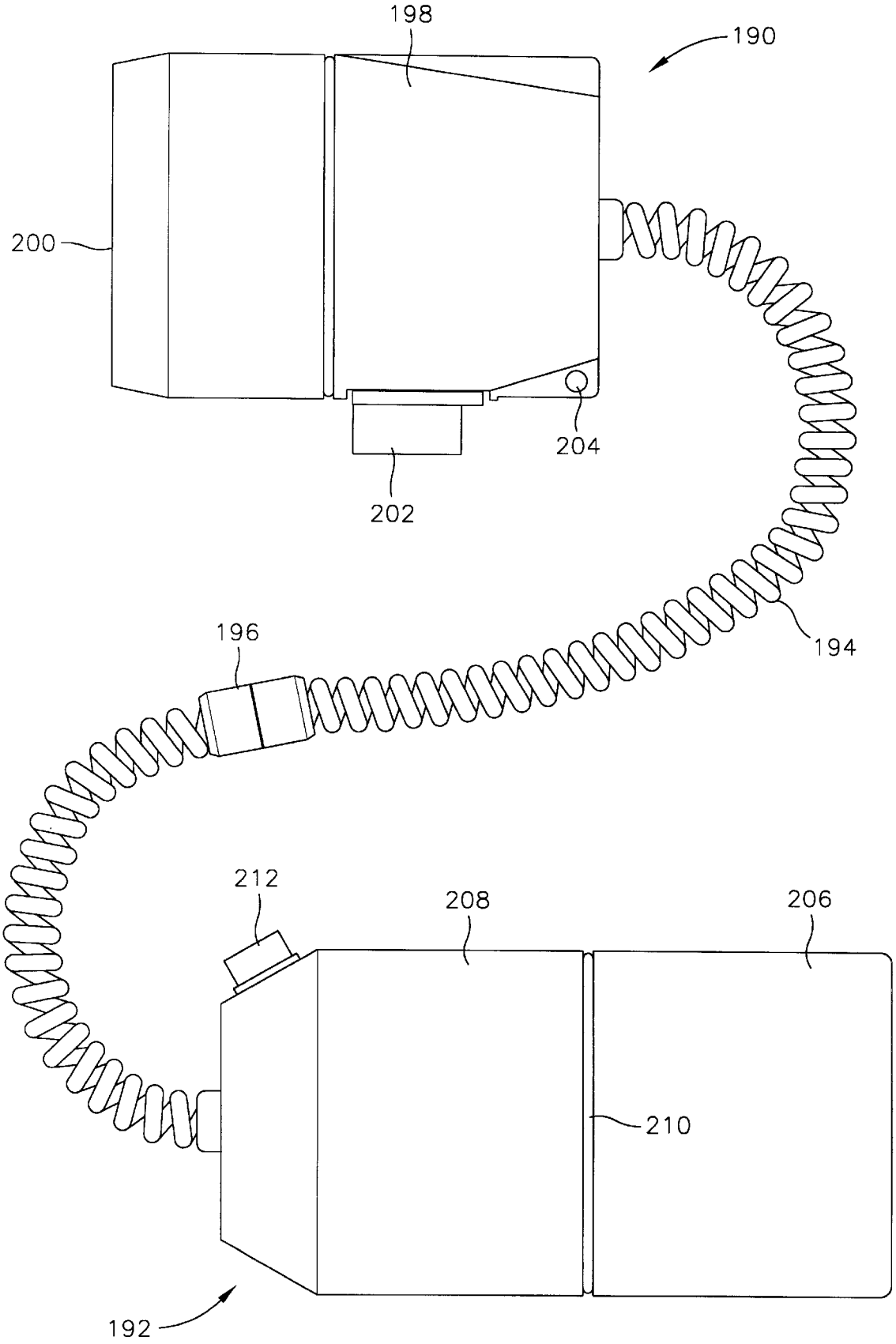
FIG. 17 is a side elevation view of an alternate embodiment having a separate lamp head and battery housing.

Referring to FIG. 17 an alternate embodiment is illustrated wherein a lamp head designated generally at 190 is connected to a battery or batteries in a separate housing or battery pack designated generally at 192 by means of a flexible coiled conductor cable or cord 194. The cable is provided with an underwater, unplugable connector 196 to enable separating the lamp head 190 from the battery pack 192. It is desirable in some applications because of the weight of the batteries, such as in certain underwater diving activities, to separate the lamp head 190 from the battery pack 192 to enable the lamp head to be easily hand manipulated. The battery pack 192 can then be strapped to the diver's body for easier carrying and manipulation.

In the two piece lamp of FIG. 17, the lamp head 190 is preferably embodied in a water tight or sealed housing 198 having a lens 200 and any or all of the other components or features in the head assembly of any or all of the previously described embodiments. A control knob 202 similar to the actuator 100 in the previous embodiments is provided for selecting a bulb or energizing a bulb, or both. As in the previously discussed embodiments, it is desirable to minimize the number of knobs, buttons or levers to manipulate for selecting and turning on and off a light. The lamp head 190 may be provided with suitable attachment means 204, such as a rib with a lanyard hole for mounting it or supporting it as necessary.

The battery pack 192 comprises a water tight housing which in the illustrated embodiment comprises a first section 206 detachably connected by suitable seal connector means to a second housing section 208. The two parts of the battery housing are separable at a suitable place such as 210 to provide access to the battery receiving chamber of the battery pack 192. The battery pack 192 may contain any number and/or combination and types of batteries as desired. However, as previously explained, the separation of the battery pack 192 from the lamp head 190 separates the weight of the batteries from the head. This enables the lamp to be provided with a larger number of batteries that can be carried in a unitary flashlight. A suitable switch 212 is provided to switch off the battery power prior to unplugging the connector 196. This switch 212 can also be used to turn on and off the lamp head, if desired.

While I have illustrated and described my invention by means of specific embodiments, it is to be understood that numerous changes and modifications may be made therein without departing from the spirit and scope of the invention, as defined in the appended claims.

I claim:

1. A lamp, comprising:

a water tight housing;

a plurality of light bulbs;

moveable mounting means in said water tight housing for mounting said bulbs;

circuit means in said water tight housing for alternately connecting a selected one of said light bulbs to a source of power for energizing the bulb;

said mounting means being moveable to selectable positions for energizing selective ones of said light bulbs;

a manually moveable actuator mounted outside said water tight housing;

linkage means connected between said actuator and said mounting means for simultaneously moving and energizing selective ones of said light bulbs; and a water tight seal surrounding a portion of the linkage means that extends through the water tight housing.

2. A lamp according to claim 1, wherein said housing includes a reflector and said actuator moves said bulbs into a focal point of said reflector.

3. A lamp according to claim 2, wherein said reflector is selected from the group consisting of a parabolic reflector, an ellipsoidal reflector and a spherical reflector.

4. A lamp according to claim 2, wherein said mounting means is pivotally mounted in said housing and carries electrical contacts for completing a circuit when said actuator moves said bulbs into the focal point of said reflector.

5. A lamp according to claim 1, wherein said housing includes a support member defining a PC board having contacts on one face for engagement with terminals of a battery and contacts on another face for engagement with terminals on said mounting means connected to said bulbs.

6. A lamp according to claim 5, wherein said mounting means is pivotally mounted on said PC board and carries electrical contacts for completing a circuit when said actuator moves said bulbs.

7. A lamp according to claim 6 wherein said electrical contacts also function as detents for locating the mounting means.

8. A lamp according to claim 7 wherein said detents are positioned on a back surface of said mounting means.

9. A lamp according to claim 5 wherein said mounting means is slideably mounted on said PC board and carries electrical contacts for completing a circuit when said actuator moves said bulbs into a focal point of said reflector.

10. A lamp according to claim 9 wherein said electrical contacts also function as detents for locating the mounting means.

11. A lamp according to claim 10 wherein said detents are positioned on a back surface of said mounting means.

12. A lamp according to claim 1, wherein said housing includes a reflector having a focal point and said bulbs are moveable relative to the focal point of the reflector.

13. A lamp according to claim 12, wherein said reflector is a two part reflector having a first part fixed in said housing and a second part mounted on said mounting means and defining said focal point.

14. A lamp according to claim 13, wherein said reflector is a parabolic reflector.

15. A lamp according to claim 13, wherein said reflector is an ellipsoidal reflector.

16. A lamp according to claim 13, wherein said reflector is a spherical reflector.

17. A lamp according to claim 1, further comprising a lens and means for providing a second water tight seal between said lens and said housing.

18. A lamp according to claim 1 wherein:

said housing is a lamp head containing said light bulbs and said actuator, and the lamp further comprises a battery pack comprising a second housing containing at least one battery; and a conductor cable connecting said housing containing said light bulbs to said battery pack.

19. A lamp according to claim 18 wherein said conductor cable is flexible and includes a detachable connector for detachably connecting said housing containing said light bulbs to said battery pack.

20. A lamp according to claim 19 wherein said battery pack includes a switch for controlling electric power to said light bulbs.

21. A lamp according to claim 18 wherein said battery pack includes a switch for controlling electric power to said light bulbs.

22. A battery powered flashlight, comprising:

a casing having walls defining an enclosed water tight chamber for receiving a battery, the casing having an opening at one end;

a support member mounted in said casing;

a closure mountable over said opening, said closure having a reflector and a lens;

a first water tight seal between said casing and said closure;

a plurality of bulbs;

a mounting member movably mounted on said support member for supporting the bulbs adjacent the reflector, said mounting member being moveable to selectable positions for energizing a selected one of said bulbs and locating the selected one of said bulbs at a focal point of said reflector;

a manually moveable actuator mounted outside said casing;

a linkage connected between said actuator and said mounting member for simultaneously moving and energizing selective ones of said plurality of bulbs; and a second water tight seal sealing a portion of the linkage that extends through the casing.

23. A flashlight according to claim 22, wherein said mounting member is pivotally mounted in said closure and carries electrical contacts for completing a circuit when said actuator moves the selected ones of said bulbs into the focal point of said reflector.

24. A flashlight according to claim 22, wherein said support member is a PC board having contacts on a first face for engagement with terminals of a battery and contacts on a second face for engagement with terminals on said mounting member connected to said bulbs.

25. A flashlight according to claim 24, wherein said mounting member is pivotally mounted on said PC board and carries electrical contacts for completing a circuit when said actuator moves said bulbs into the focal point of said reflector.

26. A flashlight according to claim 20 wherein said electrical contacts also function as detents for locating the mounting member.

27. A flashlight according to claim 26 wherein said detents are positioned on a back surface of said mounting member.

28. A flashlight according to claim 24 wherein said mounting member is slideably mounted on said PC board and carries electrical contacts for completing a circuit when said actuator moves said bulbs into the focal point of said reflector.

29. A flashlight according to claim 24 wherein said electrical contacts also function as detents for locating the mounting member.

30. A flashlight according to claim 29 wherein the detents are positioned on a back surface of said mounting member.

31. A flashlight according to claim 29, wherein said bulbs are of different types.

32. A flashlight according to claim 31, wherein said reflector is a two part reflector having a first part fixed in said closure and a second part mounted on said mounting member and defining said focal point.

33. A flashlight according to claim 32, wherein said reflector is parabolic.

34. A flashlight according to claim 33, wherein said reflector is ellipsoidal.

35. A flashlight according to claim 34, wherein said reflector is spherical.

36. A flashlight according to claim 22, wherein said bulbs are of different types.

37. A flashlight according to claim 22, wherein said reflector is a two part reflector having a first part fixed in said closure and a second part mounted on said mounting member and defining said focal point.

38. A flashlight according to claim 22, wherein the casing and the closure have mating threaded cylindrical portions which screw together.

39. A flashlight according to claim 22, wherein the mounting member includes a plurality of pin receptacles for receiving a plurality of corresponding pins of the bulbs.

40. A flashlight according to claim 22, and further comprising spring means for biasing the mounting member against the support member.

41. A lamp head, comprising:

an outer reflector portion;

a mounting member;

a plurality of bulbs mounted on the mounting member in spaced apart relationship;

a plurality of inner reflector portions mounted on the mounting member, each surrounding a corresponding one of the bulbs;

means for moving the mounting member to mate a selected one of the inner reflector portions with the outer reflector portion; and the mated inner reflector portion and outer reflector portion having a focal point and the bulb in the mated inner reflector portion being located substantially at the focal point.

42. A lamp, comprising:

a housing;

a plurality of light bulbs;

a moveable mounting means in said housing for mounting said light bulbs;

a support member in said housing defining a PC board having contacts on one face for engagement with terminals of a battery and contacts on another face for engagement with terminals on said mounting means connected to said bulbs;

circuit means in said housing for alternately connecting a selected one of said light bulbs to a source of power for energizing the bulb;

said mounting means being moveable to selectable positions for energizing selective ones of said plurality of light bulbs; and an actuator mounted on said housing and connected to said mounting means for moving and energizing selected ones of said bulbs.

43. A lamp according to claim 42 wherein said mounting means is pivotally mounted on said PC board.

44. A lamp according to claim 42 wherein said mounting means is slideably mounted on said PC board.

45. A battery powered flashlight, comprising:

a casing having walls defining an enclosed chamber for receiving a battery, the casing having an opening at one end;

a support member mounted in said casing;

a closure mountable over said opening, said closure having a reflector and a lens;

a plurality of bulbs;

a mounting member moveably mounted on said support member for supporting the bulbs above the reflector, said mounting member being moveable to selectable positions for energizing selected ones of said bulbs;

the support member being a PC board having contacts on a first face for engagement with terminals of a battery and contacts on a second face for engagement with terminals on said mounting member connected to said bulbs; and an actuator mounted on said casing and connected to said mounting member for moving and energizing selected ones of said bulbs.

46. A lamp, comprising:

a water tight housing having walls defining an enclosed chamber, the housing having an opening at one end;

a closure mountable over the opening of the water tight housing, the closure having a reflector and a lens;

a seal positioned between the water tight housing and the closure to prevent water from entering the enclosed chamber;

a plurality of bulbs;

a mounting member for supporting the bulbs adjacent the reflector, the mounting member being moveable to selectable positions for moving a selected one of the bulbs into and out of a focal point of the reflector;

the mounting member having a plurality of pin receptacles for receiving a plurality of pins of the bulbs; and an actuator connected to the mounting member for moving a selected one of the bulbs into and out of the focal point of the reflector.

47. A lamp according to claim 46 and further comprising a switch operable independent of the actuator for connecting and disconnecting the bulbs to a source of electric power.

48. A lamp according to claim 46 wherein the actuator is connected to the mounting member through a linkage having a portion that extends through a hole in the water tight housing and a second seal surrounds the portion of the linkage to prevent water from entering the enclosed chamber through the hole.

49. A lamp according to claim 46 and further comprising a water tight battery pack and a cable for conducting electric power from a battery inside the battery pack to the bulbs inside the water tight housing.

50. A lamp, comprising:

a water tight housing having walls defining an enclosed chamber, the housing having an opening at one end;

a closure mountable over the opening of the water tight housing, the closure having a reflector and a lens;

a seal positioned between the water tight housing and the closure to prevent water from entering the enclosed chamber;

a plurality of bulbs;

a mounting member for supporting the bulbs adjacent the reflector, the mounting member being moveable to selectable positions for moving a selected one of the bulbs into and out of a focal point of the reflector;

an actuator connected to the mounting member for moving a selected one of the bulbs into and out of the focal point of the reflector; and a switch operable independent of the actuator for connecting and disconnecting the bulbs to a source of electric power.

51. A lamp, comprising:

a water tight housing having walls defining an enclosed chamber, the housing having an opening at one end;

a closure mountable over the opening of the water tight housing, the closure having a reflector and a lens;

a first seal positioned between the water tight housing and the closure to prevent water from entering the enclosed chamber;

a plurality of bulbs;

a mounting member for supporting the bulbs adjacent the reflector, the mounting member being moveable to selectable positions for moving a selected one of the bulbs into and out of a focal point of the reflector;

an actuator mounted outside the water tight housing and connected to the mounting member for moving a selected one of the bulbs into and out of the focal point of the reflector, the actuator being connected to the mounting member through a linkage having a portion that extends through a hole in the water tight housing; and a second seal surrounding the portion of the linkage that extends through the hole in the water tight housing for preventing water from entering the enclosed chamber through the hole.

52. A lamp, comprising:

a water tight housing having walls defining an enclosed chamber, the housing having an opening at one end;

a closure mountable over the opening of the water tight housing, the closure having a reflector and a lens;

a seal positioned between the water tight housing and the closure to prevent water from entering the enclosed chamber;

a plurality of bulbs;

a mounting member for supporting the bulbs adjacent the reflector, the mounting member being moveable to selectable positions for moving a selected one of the bulbs into and out of a focal point of the reflector;

an actuator connected to the mounting member for moving a selected one of the bulbs into and out of the focal point of the reflector;

a water tight battery pack for enclosing at least one battery; and a cable for conducting electric power from the battery inside the water tight battery pack to the bulbs inside the water tight housing.

* * * * *

UNITED STATES PATENT AND TRADEMARK OFFICE

CERTIFICATE OF CORRECTION

PATENT NO : 5,876,110

DATED : March 2, 1999

INVENTOR(S) : Alan K. Uke

It is certified that error appears in the above-identified patent and that said Letters Patent is hereby corrected as shown below:

Column 1, line 36, delete "conditioner atmosphere" and insert - - conditions better - - .

Column 2, line 21, change "FIG. 2" to - - FIG. 2A - - .

Column 2, line 60, before "four" insert - - a - - .

Column 3, line 3, delete "12 assembly".

Column 3, line 40, change "element" to - - lever - - .

Figure 2B:
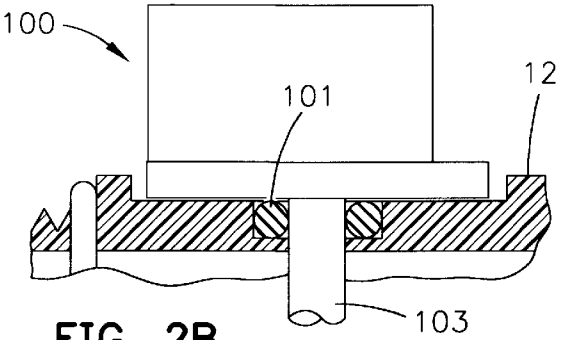
FIG. 2B is an enlarged portion of FIG. 2A that has been further fragmented to illustrate the water tight seal around the part of the linkage connected to the actuator that extends through the casing of the flashlight.

Column 5, line 16, change "FIG. 2" to - - FIG. 2B - -.

Column 5, line 32 delete "at".

Column 5, line 36, change "This" to - - The - - .

Column 5, line 61, after "102" insert - - and - - .

In Claim 34, column 9, line 24, change "33" to - - 32 - - .

UNITED STATES PATENT AND TRADEMARK OFFICE

CERTIFICATE OF CORRECTION

PATENT NO. : 5,876,110

DATED : March 2, 1999

INVENTOR(S) : Alan K. Uke

It is certified that error appears in the above-identified patent and that said Letters Patent is hereby corrected as shown below:

In Claim 35, column 9, line 26, change "34" to - - 32 - - .

Signed and Sealed this

Tenth Day of August, 1999

*Attest:*

Q. TODD DICKINSON

*Attesting Officer*

*Acting Commissioner of Patents and Trademarks*